US006724802B1

(12) United States Patent
Donaldson et al.

(10) Patent No.: US 6,724,802 B1
(45) Date of Patent: Apr. 20, 2004

(54) COOLING AND SUPPORT SYSTEMS FOR FURNACE ROOFS

(75) Inventors: Kenneth M. Donaldson, Toronto (CA); Bert O. Wasmund, Milton (CA); Ken T. Hutchinson, Mississauga (CA); Nils W. Voermann, Toronto (CA); Brett T. Emery, Mississauga (CA)

(73) Assignee: Hatch Ltd., Mississauga (CA)

( * ) Notice: Subject to any disclaimer, the term of this patent is extended or adjusted under 35 U.S.C. 154(b) by 0 days.

(21) Appl. No.: 10/454,212

(22) Filed: Jun. 4, 2003

(51) Int. Cl.[7] ..... F27D 1/02; F23M 5/06
(52) U.S. Cl. ..... 373/73; 110/332
(58) Field of Search ..... 373/71, 73, 74, 373/75, 77, 2, 8, 9; 110/331–339; 266/283; 52/485, 632, 761

(56) References Cited

U.S. PATENT DOCUMENTS 1,404,845 A * 1/1922 Gates ..... 110/332
1,711,822 A * 5/1929 Abbott ..... 110/332
4,152,534 A * 5/1979 Iwashita ..... 373/73
4,424,756 A * 1/1984 Merkle ..... 110/332
5,062,249 A * 11/1991 Smagner ..... 52/320
5,357,540 A * 10/1994 Merkle et al. ..... 373/73
6,427,610 B1 * 8/2002 Coates et al. ..... 373/73

* cited by examiner

*Primary Examiner*—Tu Ba Hoang
(74) *Attorney, Agent, or Firm*—Kirkpatrick & Lockhart LLP

(57) ABSTRACT

A system for supporting and cooling a furnace roof comprised of refractory bricks comprises a plurality of roof support members extending across the furnace and being supported from above the furnace roof. The support members are provided with internal channels for circulation of a cooling fluid, and are provided with side surfaces adapted to support rows or refractory bricks between adjacent roof support members. The system eliminates the need to suspend individual bricks from above the roof, and provides simultaneous support and cooling of the roof structure.

22 Claims, 2 Drawing Sheets

COOLING AND SUPPORT SYSTEMS FOR FURNACE ROOFS

FIELD OF THE INVENTION

The invention relates to systems for suspending and cooling refractory furnace roofs.

BACKGROUND OF THE INVENTION

High temperature furnaces have roof structures comprised of refractory bricks. The bricks are supported from hanger beams by metal hangers. A number of systems are known whereby the bricks interlock with one another so that the number of hangers may be reduced. Nevertheless, a large number of these hangers typically protrude from a furnace roof, making it difficult to keep the roof free of dust and debris, thereby hindering heat removal from the roof refractory and hence reducing its service life.

Generally, furnace roof suspension systems do not include means for cooling the refractory bricks comprising the roof. One exception is the system disclosed in U.S. Pat. No. 1,404,845 (Gates), issued on Jan. 31, 1922. This patent discloses a furnace "arch" having a grid of interconnected tubular members through which coolant is circulated. Inlets for the coolant are provided in the longitudinal tubular members and outlets for the coolant are provided in the transverse tubular members. The refractory bricks comprising the arch are notched for support from the longitudinal tubular members, while the ends of the transverse tubular members rest on the furnace walls, thereby supporting the roof.

The Gates patent shows two different arrangements for constructing an arch. In one arrangement, shown in FIG. 1 of Gates, the tubular members 15 are inserted into channels between the bricks from above, therefore requiring the use of wedges or fillers to hold the bricks in suspension. In a second arrangement, shown in FIG. 4 of Gates, a cooling tube is required between each pair of bricks.

Although the Gates system provides some advantages over conventional hanger systems, the grid of transverse and longitudinal tubular members may interfere with the ability to remove dust and debris from the furnace roof. This cleaning is essential for maximum roof life, as the dust is insulating and, if not removed, will cause the bricks to run hotter, thus reducing their life. Furthermore, it appears that the refractory bricks of the Gates furnace arch cannot be replaced from above, but rather must be replaced from inside the furnace, requiring a furnace cold shutdown and consequent loss of production.

In addition, supporting the roof on the walls as disclosed by Gates is undesirable in that the roof must be removed or otherwise supported to replace the wall bricks, which must typically be done much more frequently than roof repairs.

In order to address these deficiencies in the prior art, it is desirable to provide an improved system for suspending and cooling a refractory furnace roof.

SUMMARY OF THE INVENTION

The present invention overcomes the disadvantages of the prior art by providing a system for supporting the roof of a furnace, the system comprising a plurality of elongate roof support members extending across the furnace, with the bricks of the furnace roof being supported by support surfaces on the sides of the roof support members in such a manner that the bricks are removable from above the roof.

The roof support members are preferably provided with at least one interior coolant passage which circulates a cooling fluid between a coolant inlet and a coolant outlet. In the preferred embodiment, the roof support members thus simultaneously serve the dual purpose of both supporting and cooling the bricks.

In the system according to the invention, the need to attach hangers to individual bricks is eliminated, and the bricks can be removed and replaced from above without shutting down the furnace to a cold state, thereby greatly simplifying and shortening the time duration and expense of repair procedures. Furthermore, in the preferred system of the invention, the coolant inlets and outlets are provided in the roof support members, thereby eliminating the need for coolant-carrying cross members as in the Gates patent.

In one aspect, the present invention provides a roof for substantially covering an interior space of a furnace, the furnace roof comprising: a plurality of elongate roof support members extending across a top of the furnace, with spaces being provided between adjacent roof support members; a plurality of refractory bricks provided in the spaces between adjacent roof support members, the roof support members and refractory bricks substantially completely covering the interior space, wherein the bricks are arranged in rows extending along the roof support members, with at least one row of bricks being provided between adjacent roof support members, each of the bricks having a bottom surface facing the interior of the furnace, a top surface facing away from the interior of the furnace, and a pair of opposed side surfaces extending between the top and bottom surfaces; and each of the roof support members having opposed sides extending along substantially its entire length, at least one of the sides being provided with a support surface which is in direct contact with the side surfaces of a plurality of the refractory bricks of one said row of bricks, and upon which said plurality of refractory bricks is at least partially supported, wherein the side surfaces of the bricks and the sides of the roof support members are shaped such that the bricks which are in direct contact with the support surface of the roof support member can be removed from the space between adjacent roof support members by raising the bricks from above the roof.

In another aspect, the present invention provides a support member for supporting a plurality of refractory bricks in a furnace roof, the support member being elongate and having a first end, a second end and a pair of opposed sides extending along substantially its entire length, each of the sides being provided with a support surface for supporting said refractory bricks, wherein said support surfaces each comprise a shoulder forming a transition between upper and lower portions of one of one of the sides, such that a width of the roof support member between the upper portions of the sides is less than a width of the roof support member between the lower portions of the sides.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
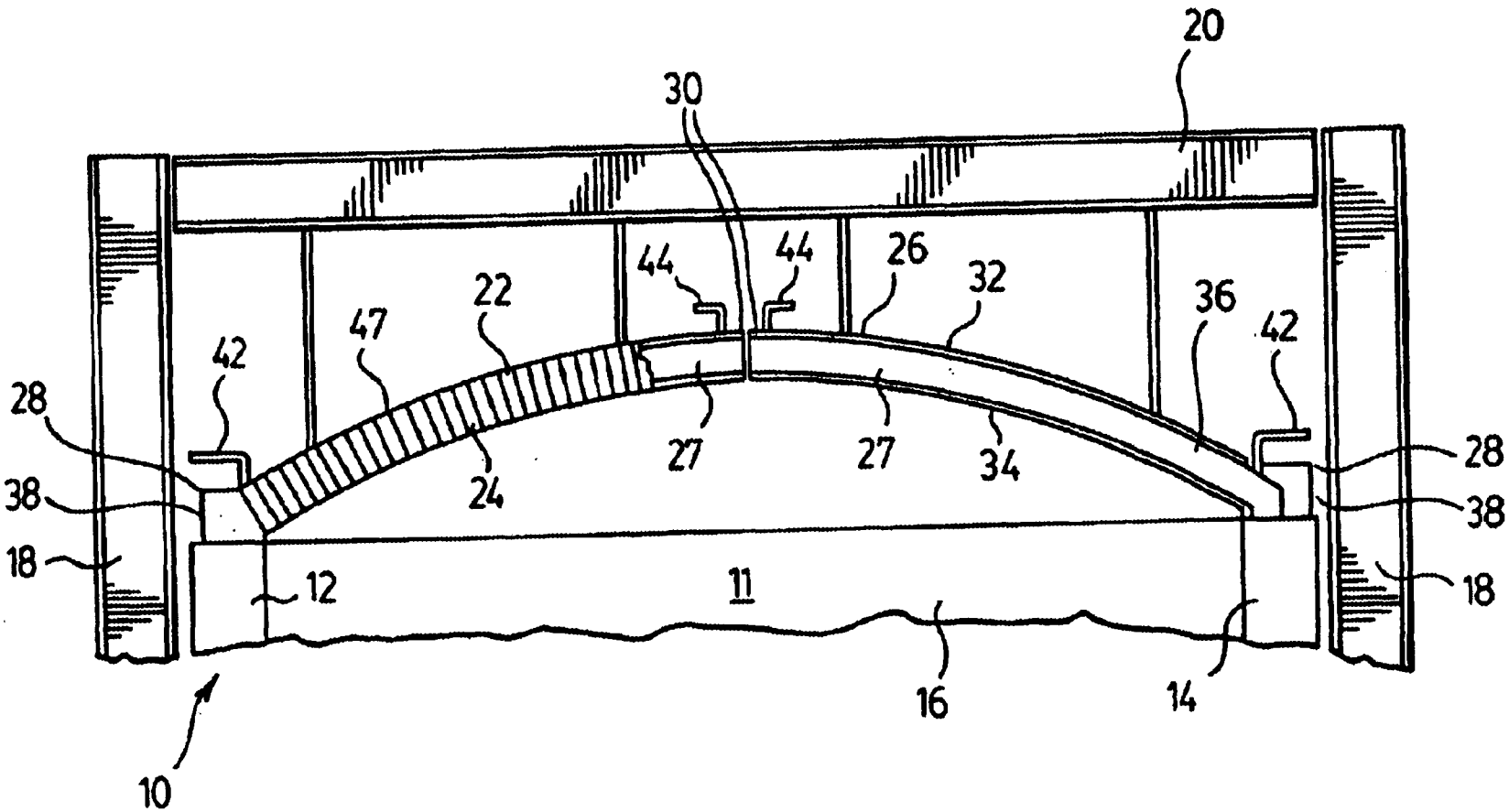
FIG. 1 is a schematic transverse cross-section through a furnace roof incorporating a preferred system according to the present invention.

FIG. 1 schematically illustrates a portion of a furnace 10 being rectangular in shape and having four vertically extending walls surrounding an interior space 11, the walls preferably formed from a refractory material. Portions of side walls 12, 14 and end wall 16 are illustrated in FIG. 1. Although the preferred embodiment of the invention is described in connection with a rectangular furnace, it will be appreciated that the principles embodied in the present invention can be applied to furnaces of various shapes, for example circular furnaces having generally cylindrical side walls.

Supporting the side walls 12 and 14 of furnace 10 are vertical beams 18 commonly referred to as "buckstays". These buckstays are paired along opposite sides of the furnace 10. Although only one pair of buckstays 18 is illustrated in FIG. 1, it will be appreciated that there are preferably a plurality of such pairs spaced along the lengths of side walls 12 and 14. Extending horizontally between each pair of buckstays is a horizontal girder 20. The buckstays 18 and girder 20 are illustrated in the drawings as comprising I-beams. However, beams having other cross sections may also be suitable.

Substantially completely covering the open top of furnace 10 is a roof 22 which, in the preferred embodiment shown in the drawings, is arch-shaped and comprises a plurality of refractory bricks 24 and a plurality of elongate support members 26. It will, however, be appreciated that the roof is not necessarily arch-shaped, and may instead be flat. In fact, the benefits of using the support system according to the invention may be greater in a flat roof than in an arched roof, since an arched roof is at least partially self-supporting and would generally have fewer brick hangers than a flat roof. It will also be appreciated that the roof 22 may be formed with openings (not shown) for charging of materials or to receive electrodes.

Figure 2:
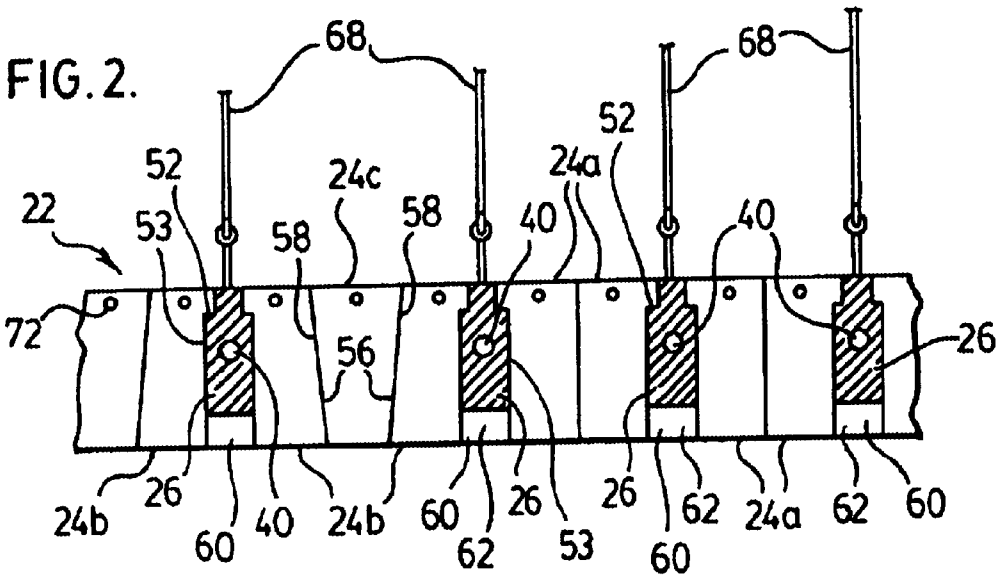
FIG. 2 is a longitudinal cross-section through a portion of the furnace roof of FIG. 1.

The elongate roof support members 26 extend across the top of the furnace 10, with spaces being provided between adjacent roof support members 26. In the preferred system shown in the drawings, in which the furnace 10 is rectangular, the roof support members 26 are arranged in spaced, parallel relation to one another along the opposed side walls 12, 14 of furnace 10, as illustrated in FIG. 2, or may be parallel to the end walls 16.

In the preferred embodiment of the invention, the roof support members 26 are each comprised of a pair of roof support beams 27 arranged in end-to-end, parallel relation to one another to form a roof support member 26. Each of the roof support beams 27 has a first end 28, a second end 30, an upper surface 32, a lower surface 34 and a pair of opposed side surfaces 36. The upper surface 32, lower surface 34 and side surfaces 36 are also referred to herein as the upper, lower and side surfaces of the roof support members 26. Although the roof support members 26 shown in the drawings comprise two roof support beams 27 arranged end-to-end, it will be appreciated that the roof support beams 26 may instead be comprised of a single beam 27 extending completely across the furnace 10, or that the roof support members 26 may each be comprised of more than two roof support beams 27 arranged end-to-end.

The first end 28 of each roof support beam 27 is located proximate an outer edge 38 of the furnace roof 22 and may be at least partially supported on a side wall 12 or 14 of the furnace 10. However, it will be appreciated that the roof support beams 27 are not necessarily supported on the side walls 12 or 14 of the furnace. Rather, the beams 27 may be entirely supported by other means, such as by suspension from support members located above the furnace roof 22.

Each of the roof support members 26 is preferably provided with at least one interior coolant passage 40 through which a liquid coolant, such as water, is circulated in order to maintain the temperature of the support members 26 and the refractory bricks of the roof 22 within a desired range. The interior coolant passage 40 extends continuously between a coolant inlet 42 and a coolant outlet 44. In preferred embodiments of the invention in which the roof support members 26 are comprised of a plurality of roof support beams 27, each beam 27 is preferably provided with an internal coolant passage 40, an inlet 42 and an outlet 44.

The locations of the coolant inlets 42 and 44 in the roof support beams 27 are variable. For example, as shown in FIG. 1, the inlet 42 may be located proximate the first end 28 of the roof support beam 27, at the edge 38 of roof 22, and the outlet 44 is provided at the second end 30 of the roof support beam 27. However, it may be preferred to locate both the coolant inlet 42 and the coolant outlet 44 proximate the first end 28 of the roof support member 26, with the coolant passage 40 being U-shaped and extending from the inlet 42 to a point proximate the second end 30 of the roof support member 26, and back to the outlet 44. Location of the inlet 42 and outlet 44 at the edge of the furnace may be preferred as it brings the piping connections away from the top of the furnace roof.

As shown in FIG. 2, the spaces between adjacent roof support members 26 are filled with refractory bricks, which are generally identified herein by reference numeral 24. The drawings, however, show three different shapes of bricks which are identified in FIG. 2 by references 24*a*, 24*b* and 24*c*. The bricks 24 are arranged in rows 47 (FIG. 1) extending along the roof support members 26, with at least one row of bricks 24 being provided between each adjacent pair of roof support members 26. In the preferred embodiment shown in the drawings, two or three rows of refractory bricks 24 are supported between adjacent pairs of roof support members 26 (FIG. 2).

At least one of the side surfaces 36 of roof support members 26 are each provided with a support surface 50 with which a plurality of refractory bricks 24 are in direct contact and on which they are at least partially supported. Preferably, both side surfaces 36 are provided with support surfaces 50 extending along substantially the entire length of the roof support member 26.

In the preferred embodiment shown in the drawings, each support surface 50 comprises a shoulder forming a transition between upper and lower portions 49 and 51 of the side surfaces 36. In the preferred embodiment shown in the drawings, the upper and lower portions 49, 51 are parallel to one another and substantially flat, with the shoulder 50 extending outwardly between the upper and lower portions 49, 51. Therefore, the width of the roof support member 26, measured between the upper portions 49 of side surfaces 36, is less than the width of the roof support member 26 measured between the lower portions 51 of the side surfaces.

As shown in FIG. 2, the bricks 24*a* or 24*b* which are in direct contact with the roof support members 26 each have a side surface 53 which is shaped to mate with a side surface 36 of a roof support member 26. In the preferred embodiment shown in the drawings, the side surfaces 53 of bricks

24*a* and 24*b* each have a mating shoulder 52 which is directly supported on the shoulder 50 of a support member 26, such that the upper portions of bricks 24*a* and 24*b* have a wider transverse cross section than the lower portions of bricks 24*a* and 24*b*. As used herein with reference to bricks 24, the term "directly supported" is intended to mean that these bricks are at least partially supported by direct contact with the supporting surfaces of the roof support members 26.

Figure 4:
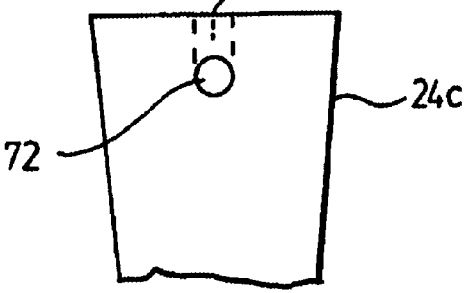
FIG. 4 is an enlarged view of a refractory brick shown in FIG. 2.
Figure 3:
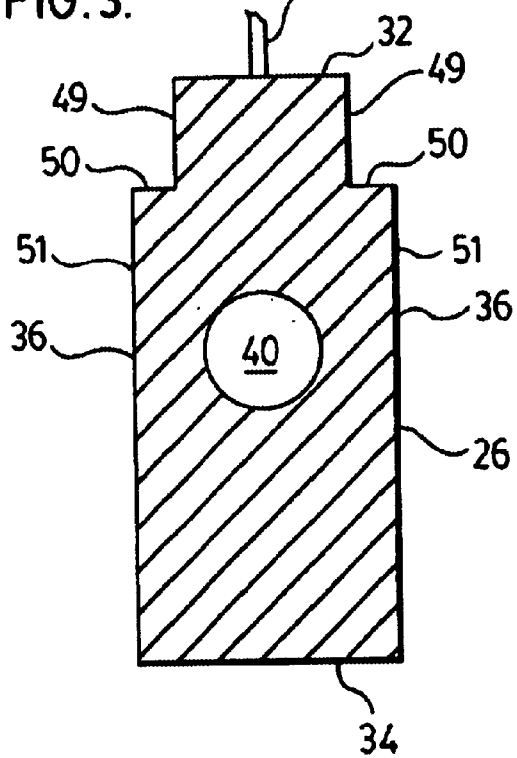
FIG. 3 is an enlarged cross section through one of the roof support members shown in FIG. 2.

Therefore, the side surfaces 53 of the bricks 24*a* and 24*b* and the side surfaces 36 of roof support members 26 are shaped such that the bricks 24*a* and 24*b*which are in direct contact with the side surface 36 of the support member 26 can be removed from the space between adjacent support members 26 by raising them from above. In some preferred embodiments, each of the bricks 24 may be individually removable from above, while in others a group of bricks 24 must be simultaneously removed. However, it will be appreciated that the bricks can be removed from above without repositioning or removing the support members. In order to assist in removing the bricks 24 from above, each of the bricks 24 is preferably provided with at least one hole 70 (FIG. 4) in its upper surface through which the brick may be hooked for removal from above. The holes 70 may preferably intersect with a horizontal bore 72 (FIG. 4) so as to allow the bricks 24 to be lifted by a tool with a hooked end (not shown).

As mentioned above, there is at least one row of bricks 24 between adjacent roof support members 26. In typical installations, there will be up to two rows of refractory bricks 24 between adjacent roof support members 26. Where there is only one row of bricks 24 between adjacent roof support members, the bricks 24 will be T-shaped (not shown), having a pair of opposed side surfaces 53 provided with shoulders 52 which are supported on the shoulders 50 of the adjacent support members 26. Where there are two rows of bricks 24*a* between adjacent roof support members, as in the right hand portion of FIG. 2, each of the rows will be in direct contact with one of the roof support members 26.

In some portions of the furnace roof 22, the cooling requirements will be less, and therefore the spacing between adjacent roof support members 26 can be increased. This is schematically illustrated in the left hand side of FIG. 2. In regions where the spacing between adjacent roof support members 26 is relatively large, there will be at least one row of bricks 24*c* which are not in direct contact with any of the roof support members 26. These bricks 24*c* are wedge-shaped and are provided between rows of bricks 24*b* which have side surfaces 53 provided with shoulders 52 and are directly supported by the roof support members 26. The wedge-shaped bricks 24*c* are indirectly supported by roof support members 26, and preferably have downwardly and inwardly converging faces 56 and will mate with downwardly and outwardly diverging rear faces 58 of bricks 24*b*. As used herein with reference to bricks 24*c*, the term "indirectly supported" is intended to mean that these bricks are supported by roof support members 26, but are not in direct contact with the supporting surfaces of the roof support members 26. It will be appreciated that all the bricks 24 shown in the drawings are removable from above the furnace roof 22.

In the preferred embodiment shown in the drawings, the bricks 24 and the roof support members 26 are configured such that the upper surfaces 32 of roof support members 26 are substantially flush with the upper surface of the furnace roof 22. This assists in maintaining the top of roof 22 clean and free from dust and debris. In another preferred embodiment, the roof support members 26 each have a height, measured between their upper and lower surfaces 32 and 34, which is less than the thickness of the furnace roof 22 such that the lower surface 34 of each roof support member 26 is inset relative to the lower surface of the furnace roof. This forms a channel in the lower surface of the furnace roof which extends along the length of the support member 26. This channel 60 is preferably filled by a refractory material, for example in the form of a plug of castable material, thereby protecting the lower surface 34 of roof support member 26 from direct exposure to the intense heat flux inside the furnace. It will be appreciated that the refractory material will be eroded during operation of the furnace and will be replaced by a frozen slag and/or dust accretion.

In order to better retain the refractory material 62 inside channel 60, the refractory material 62 may be keyed into a dovetail-shaped slot (not shown) formed in the lower surface 34 of each roof support member 26.

The furnace roof 22 in the preferred embodiment is arched across the furnace between side walls 12 and 14. Accordingly, each of the roof support members is arcuate. In the preferred embodiment shown in the drawings, each of the roof support members 26 extends partway across the furnace 10, and preferably extends approximately halfway across the furnace 10. As shown in FIG. 1, the roof support members 26 are paired end-to-end with one another, such that the second ends 30 of a pair of roof support members are in close proximity to one another, and are preferably joined together, such that the paired support members 26 together extend across the entire width of the furnace 10.

The roof support members are supported from above the furnace by a plurality of elevated support members which, in the preferred embodiment shown in the drawings, comprise horizontal girders 20. As mentioned above, the girders 20 extend across the width of furnace 10 and above the roof 22 and the roof support members 26. Preferably, each of the roof support members 26 is supported at one or more points along its length from one of the girders 20. More preferably, the roof support members 26 and the girders 20 are parallel to one another, and each of the roof support members 26 is supported at two or more points along its length from a girder 20. As shown in the drawings, the roof support members are supported from the girders 20 by hangers 68, which preferably are comprised of metal rods.

Although the roof support members 26 are shown in the preferred embodiment as being hung from girders 20, it will be appreciated that a number of alternate arrangements for supporting the roof support members exist, and that such alternate arrangements may be preferred in some embodiments of the invention. For example, other types of elevated support members could be used, such as support members which extend perpendicular to the roof support members 26.

Although the invention has been described in connection with certain preferred embodiments, it is not limited thereto. Rather, the invention includes all embodiments which may fall within the scope of the following claims.

What is claimed is:

1. A roof for substantially covering an interior space of a furnace, the furnace roof comprising:

a plurality of elongate roof support members extending across a top of the furnace, with spaces being provided between adjacent roof support members;

a plurality of refractory bricks provided in the spaces between adjacent roof support members, the roof support members and refractory bricks substantially completely covering the interior space, wherein the bricks are arranged in rows extending along the roof support members, with at least one row of bricks being provided between adjacent roof support members, each of the bricks having a bottom surface facing the interior of the furnace, a top surface facing away from the interior of the furnace, and a pair of opposed side surfaces extending between the top and bottom surfaces; and each of the roof support members having opposed sides extending along substantially its entire length, at least one of the sides being provided with a support surface which is in direct contact with the side surfaces of a plurality of the refractory bricks of one said row of bricks, and upon which said plurality of refractory bricks is at least partially supported, wherein the side surfaces of the bricks and the sides of the roof support members are shaped such that the bricks which are in direct contact with the support surface of the roof support member can be removed from the space between adjacent roof support members by raising the bricks from above the roof.

2. The furnace roof according to claim 1, wherein each of the roof support members have at least one interior coolant passage, at least one coolant inlet and at least one coolant outlet, wherein each said interior coolant passage extends continuously between an inlet and an outlet.

3. The furnace roof according to claim 1, wherein the furnace is a rectangular furnace having four side walls and wherein said roof support members are arranged in spaced, parallel relation to one another along an opposed pair of said side walls.

4. The furnace roof according to claim 1, wherein the furnace is circular and wherein said roof support members are arranged in spaced parallel relation to one another chordwise across the entire furnace or chordwise across segments of the furnace.

5. The furnace roof according to claim 1, wherein each of said roof support comprises a plurality of roof support beams arranged in end-to-end relation to one another.

6. The furnace roof according to claim 1, wherein the furnace roof comprises an arch and wherein each of the roof support members is arcuate; or wherein the furnace roof is flat and each of the roof support members is straight.

7. The furnace roof according to claim 1, further comprising a plurality of elevated support members extending across the furnace and above the roof, wherein the roof support members are spaced below the elevated support members.

8. The furnace roof according to claim 7, wherein each of the elevated support members comprises a horizontal beam extending between a pair of vertical buckstays located on opposite sides of the furnace.

9. The furnace roof according to claim 7, wherein each of the roof support members is supported at one or more points along its length from one of the elevated, support members.

10. The furnace roof according to claim 9, wherein the roof support members and the elevated support members are parallel to one another, and wherein each of the roof support members is supported at a plurality of points along its length from one of the elevated support members.

11. The furnace roof according to claim 9, wherein the roof support members are supported from the elevated support members by hangers.

12. The furnace roof according to claim 2, wherein at least one of the coolant inlet and the coolant outlet are located proximate the first end of the roof support member in which it is provided.

13. The furnace roof according to claim 2, wherein both the coolant inlet and the coolant outlet are located proximate the first end of the roof support member in which they are provided.

14. The furnace roof according to claim 1, wherein both sides of at least some of the roof support members are provided with said support surfaces, and wherein said support surfaces each comprise a shoulder forming a transition between upper and lower portions of one of one of the sides, such that a width of the roof support member between the upper portions of the sides is less than a width of the roof support member between the lower portions of the sides.

15. The furnace roof according to claim 14, wherein the lower portions of the sides are substantially parallel to one another and are in substantial engagement with side surfaces of said refractory bricks.

16. The furnace roof according to claim 14, wherein at least some of the bricks of the furnace roof are provided with shoulders which engage the shoulders of the roof support members.

17. The furnace roof according to claim 16, wherein each roof support member has an upper surface which is substantially flush with an upper surface of the furnace roof.

18. The furnace roof according to claim 17, wherein each of the roof support members has a height, measured between its upper and lower surfaces, which is less than a thickness of the furnace roof, such that the lower surface of the roof support member is inset relative to a lower surface of the furnace roof, and wherein a space between the lower surface of the roof support member and the lower surface of the furnace roof is substantially filled by refractory material.

19. The furnace roof according to claim 18, wherein the refractory material is keyed into a slot in the lower surface of the roof support member.

20. A support member for supporting a plurality of refractory bricks in a furnace roof, the support member being elongate and having a first end, a second end and a pair of opposed sides extending along substantially its entire length, each of the sides being provided with a support surface for supporting said refractory bricks, wherein said surface comprises shoulder forming a transition between upper and lower portions of one of the sides, such that a width of the roof support member between the upper portions of the sides is less than a width of the roof support member between the lower portions of the sides.

21. The support member according to claim 20, wherein the lower portions of the sides are substantially parallel to one another.

22. The support member according to claim 20, further comprising at least one interior coolant passage, at least one coolant inlet and at least one coolant outlet, wherein each said interior coolant passage extends continuously between an inlet and an outlet.

* * * * *